United States Patent [19]

Walton

[11] Patent Number: 4,724,629

[45] Date of Patent: Feb. 16, 1988

[54] ILLUMINATED DISPLAY BOARD

[75] Inventor: Roger Walton, Bury St Edmunds, England

[73] Assignee: VCH International Limited, Suffolk, England

[21] Appl. No.: 852,415

[22] Filed: Apr. 16, 1986

[30] Foreign Application Priority Data

Apr. 24, 1985 [GB] United Kingdom ..... 8510466

[51] Int. Cl.[4] ..... G09F 9/40; G09F 9/307; G09F 13/14; G09F 13/28

[52] U.S. Cl. ..... 40/451; 40/447; 40/450; 40/452; 40/550

[58] Field of Search ..... 40/446, 447, 450, 451, 40/452, 550

[56] References Cited

U.S. PATENT DOCUMENTS

| | | | |
|---|---|---|---|
| 2,137,360 | 11/1938 | Skelsey | 40/451 |
| 2,230,152 | 1/1941 | Wolfrey | 40/451 |
| 3,163,949 | 1/1965 | Gley | 40/452 |
| 3,197,904 | 8/1965 | Holcomb | 40/452 |
| 3,545,114 | 12/1970 | Hurst et al. | 40/451 |
| 3,723,961 | 3/1973 | McNaney | 40/452 |
| 3,768,188 | 10/1973 | Kurtenback et al. | 40/451 |
| 3,810,168 | 5/1974 | Nishina | 340/383 |
| 3,858,341 | 1/1975 | Wakabayaski | 40/451 |
| 3,924,227 | 12/1975 | Stolov | 340/336 |
| 3,972,139 | 8/1976 | Slomkowski | 40/28 C |
| 4,254,453 | 3/1981 | Mouyard et al. | 362/240 |
| 4,336,580 | 6/1982 | Mouyard et al. | 362/347 |
| 4,345,308 | 8/1982 | Mouyard et al. | 362/332 |

FOREIGN PATENT DOCUMENTS

| | | | |
|---|---|---|---|
| 2115192 | 10/1972 | Fed. Rep. of Germany . | |
| 2643036 | 3/1978 | Fed. Rep. of Germany | 40/447 |
| 2495804 | 11/1982 | France . | |
| 28452 | 1/1904 | Switzerland | 40/452 |
| 245492 | 1/1926 | United Kingdom | 40/452 |
| 386189 | 1/1933 | United Kingdom . | |
| 625049 | 6/1949 | United Kingdom | 40/452 |
| 1104303 | 2/1968 | United Kingdom . | |
| 1247380 | 9/1971 | United Kingdom . | |
| 1363169 | 8/1974 | United Kingdom . | |

*Primary Examiner*—William F. Pate, III
*Assistant Examiner*—Michael Safavi
*Attorney, Agent, or Firm*—Barry R. Lipsitz

[57] ABSTRACT

An illuminated display assembly fits into an opening in a display board such as a sports scoreboard. The display assembly includes an indicator module containing a front panel having a plurality of light transmitting data indicating areas arranged thereon with a plurality of chambers mounted behind the front panel. Each chamber is associated with one of the data indicating areas and encloses light sources therein which illuminate the data indicating areas when energized. A light source module includes a printed circuit board having a plurality of light sources mounted thereto. When the light source module and indicator modules are assembled together, the light sources from the former project into the chambers in the latter to form a finished display.

14 Claims, 3 Drawing Figures

ILLUMINATED DISPLAY BOARD

FIELD OF THE INVENTION

This invention relates to a display board which can be selectively illuminated in order to display information. The board is particularly suitable for use as a scoreboard for sports events, but may also find application in auction sale rooms, at point of sale locations and in other areas. The board can display numerals and/or letters and/or other images.

BACKGROUND OF THE INVENTION

Display boards are known where the outlines of the characters to be displayed are delineated by a series of individual light sources. Depending on the size and scale of the display board, these light sources may be light emitting diodes or individual filament bulbs. The light sources are switched on in predetermined patterns, depending on the character which is to be displayed.

The appearance of these types of display is often not very satisfactory, mainly because they rely on the viewer being able to interpret a pattern of individual light sources as a particular character being displayed.

SUMMARY OF THE INVENTION

According to the present invention, there is provided a display board where the information to be displayed is illuminated on the board. The board comprises a front panel having printed or otherwise placed thereon a plurality of light transmitting data indicating areas. Behind each data indicating area are a plurality of discrete light sources, such as incandescent lamps, wherein all the light sources for a particular data indicating area are grouped in a common chamber or trough behind the front panel. The walls of the troughs are adapted to reflect light from the light sources up through the associated data indicating areas.

With this display board, each data indicating area, illuminated by a number of light sources, actually appears as a single band of light when illuminated. This gives the board a very much better appearance and makes the information displayed on it much clearer than was possible with prior art boards, where the individual light sources were all directly visible. In particular, a board in accordance with the invention can be read accurately over a much wider angle of vision than was possible in prior art boards. And, an important feature of the invention is that one or even more of the plurality of discrete light sources (e.g., light bulbs) may be burned out, and the illuminated data indicating area will still be lit over its entire surface. In fact, in such instance only a slight variation of surface brightness can be detected. This feature is a result of the overall construction of the front and rear panel assembly, and the use of a plurality of light sources for each data indicating area.

The data indicating areas are preferably printed with a coating of a light-diffusing character. The troughs containing the light sources may be produced by vacuum forming or by injection molding and may be secured directly to the back of the front panel to form an indicator module. In one particularly advantageous embodiment, all the troughs for all the data indicating areas are made in a single molding which is adhesively secured to the back of the front panel.

Preferably, the troughs have holes in their bases which correspond to the positions of the light sources, so that the troughs can simply be fitted over the light sources, e.g., in a press-fitting arrangement.

The light sources are preferably mounted on a substrate such as a printed circuit board to form a light source module, and appropriate connections are provided on the printed circuit board to enable the light sources to be electrically energized in a desired pattern corresponding to the information to be displayed.

The front panel can conveniently be of polycarbonate sheet with a non-reflective finish on its outer face. The data indicating areas can be printed in a particular color, which will be the color produced to indicate data when the light sources are illuminated, and with a contrasting color over the rest of the surface of the front panel. The data indicating areas can be arranged to provide the segments of a seven-segment display, which are capable of displaying any number between 0 and 9 by appropriate selective energization of the light sources.

BRIEF DESCRIPTION OF THE DRAWINGS

The invention will now be further described, by way of example, with reference to the accompanying drawings, in which.

DETAILED DESCRIPTION OF THE INVENTION

Figure 1:
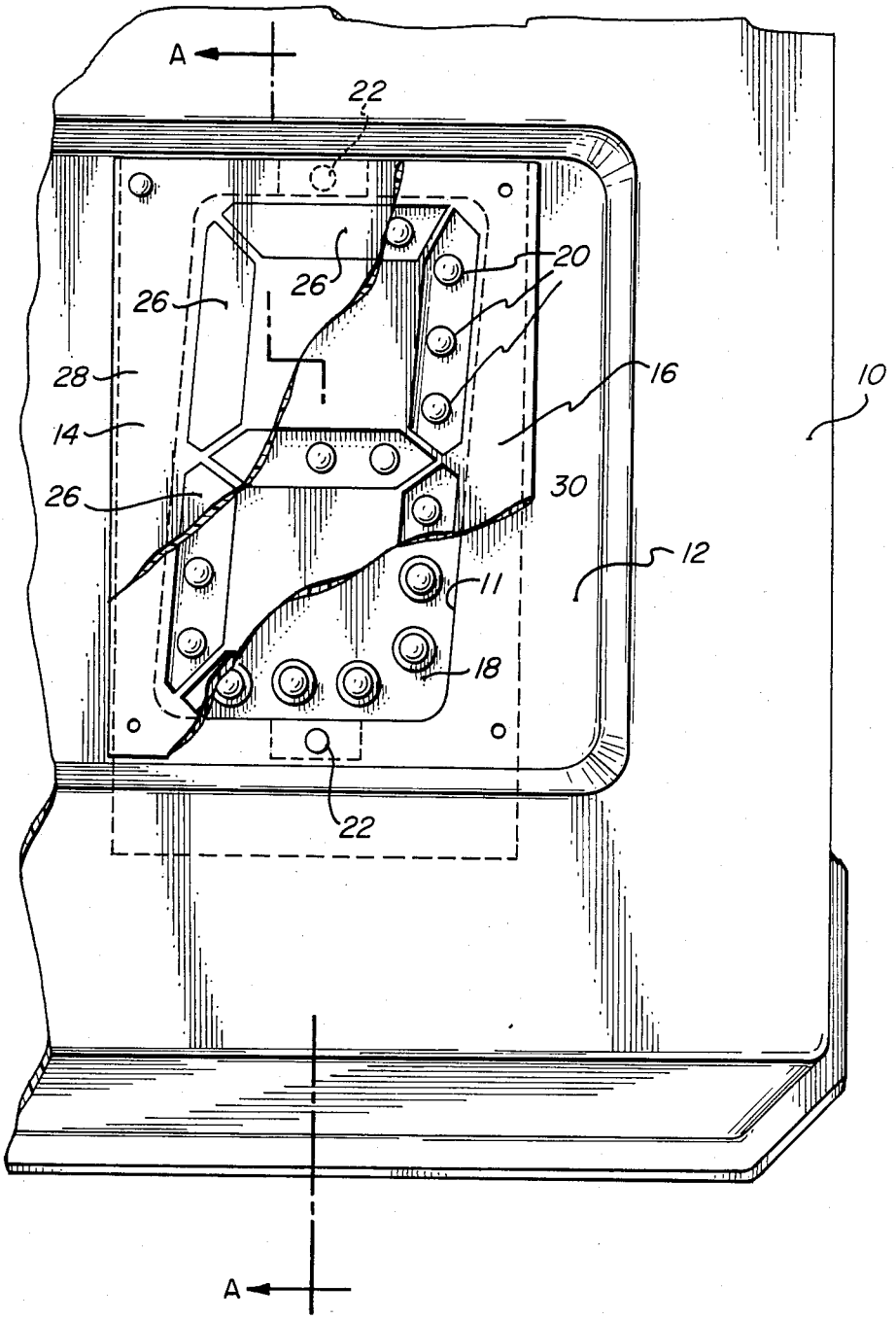
FIG. 1 is a front view of part of a display board in accordance with the invention with parts of the front of the board cut away.
Figure 2:
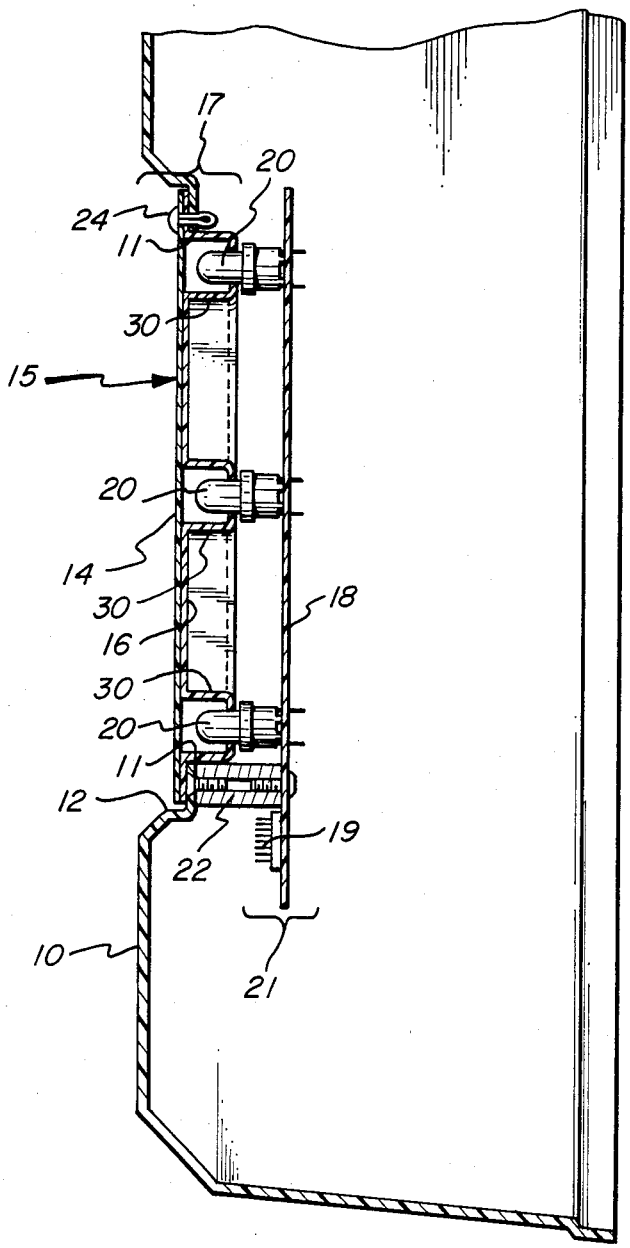
FIG. 2 is a section through the board of FIG. 1 on the line A—A.
Figure 3:
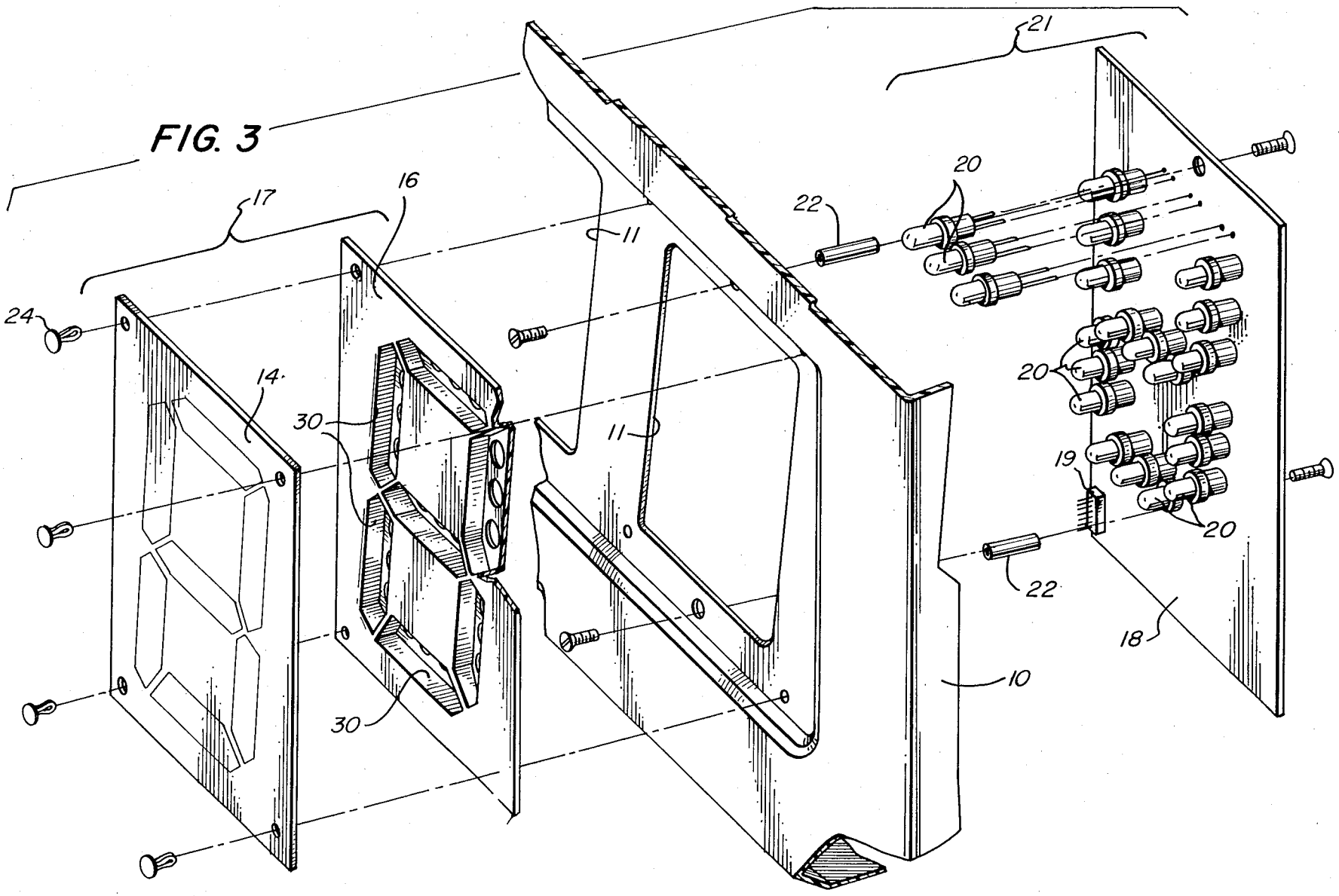
FIG. 3 is an exploded view showing the construction of the overall assembly.

The display board shown in the Figures has a base 10 with a display region 12. The region 12 has several seven-segment numerical displays, one of which (display assembly 15) is shown in FIG. 1.

The display assembly 15 is fitted in an opening 11 in the base 10 of the board. Display assembly 15 comprises a front panel 14, a molded back panel 16 and a printed circuit board 18. A number of light sources 20 (e.g., in the form of tungsten filament bulbs fitted in bulb holders) are mounted on the printed circuit board 18. The combination of the light sources 20 and the printed circuit board 18 form a light source module 21.

The circuit board 18 and the bulbs 20 are first secured to the base 10 through a number of fastenings 22. The back panel 16 and the front panel 14 are assembled by gluing together their coplanar faces to form an indicator module 17 and then this assembly is fitted to the front of the base 10 and held in place by a number of clips 24. Base 10 thereby provides a common support for indicator module 17 and light source module 21.

The front panel 14 is preferably a polycarbonate sheet which is initially transparent. Its front surface is given a non-reflective finish, and the rear surface of the sheet is then silk screen printed with bars of light transmitting color over segments 26 and with a contrasting color over the rest of its surface 28. For example, the bars of color forming the segments 26 may be red and the rest of the surface 28 may be black. A grey filter is preferably also incorporated in the areas 26 to make the segments 26 less noticeable against the background surface 28 when the bulbs 20 are not illuminated. The segments 26 may also have a white coating to promote emergence of the light emitted from the individual bulbs 20 when the latter are illuminated.

The back panel 16 is a vacuum formed or injection molded component with a number of chambers or troughs 30 formed therein. The outline of the chambers 30 corresponds generally to the shape of the segments 26 on the front panel 14. As can be seen from the figures, each chamber 30 contains three bulbs 20. The individual chambers 30 do not communicate with one another so that each chamber provides illumination only for the segment it is mounted behind. Each chamber 30 has a reflective (e.g., white) inside surface which affords multiple reflection of the light from the three corresponding bulbs 20 so as to diffuse the light.

The respective segments 26 of the seven-segment display shown will be activated in a conventional manner to display any number between 0 and 9. When any one segment is to be illuminated, all three bulbs 20 in that segment will be illuminated. Because these three bulbs 20 are all positioned in a common chamber 30 behind the segments 26 of light-diffusing and transmitting material, a uniformly lit light bar will be seen when the bulbs are illuminated. An observer will not be aware that the "bar" in fact conceals three localized light sources. Even if one or two of the three bulbs are burned out, the lighted segment will still be lit over its entire surface, resulting in enhanced reliability for the display assembly.

Printed circuit board 18 contains circuitry which connects the individual light sources 20 via connector 19 to appropriate control circuitry (not shown) which decodes data input thereto and selectively energizes the light sources 20 to display the segments 26 necessary to form a desired character. As noted, the seven-segment display shown can be used to display any number between 0 and 9. Those skilled in the art will appreciate that other segment layouts can be used to display different symbols, such as letters.

What is claimed is:

1. An illuminated display assembly comprising:

a front panel;

a plurality of light transmitting data indicating areas arranged on said front panel;

a plurality of discrete light sources behind each data indicating area of said front panel said plurality of light sources being mounted on a substrate to form a light source module;

a plurality of chambers mounted directly to a back surface of said front panel to form an indicator module, each of said chambers being associated with one of said data indicating areas and enclosing the light sources behind the associated data indicating area, said chambers having reflective interior surfaces to reflect light from the light sources enclosed therein through the associated data indicating area of the front panel, means for securing said plurality of light sources to said indicator module, the securing means comprising openings in each of said chambers for receiving the light sources therein, each of said openings being sized so that said plurality of discrete light sources contact said openings to secure said light source module to said indicator module.

2. The display assembly of claim 1 wherein said chambers comprise vacuum formed plastic.

3. The display assembly of claim 1 wherein said chambers comprise injection molded plastic.

4. The display assembly of claim 1 wherein said plurality of chambers are formed in a single member that is mounted to the back surface of said front panel.

5. The display assembly of claim 1 further comprising means for connecting said light sources on said substrate to electrical energization means for illuminating the light sources in a desired pattern corresponding to information to be displayed.

6. The display assembly of claim 5 wherein said substrate is a printed circuit board.

7. The display assembly of claim 5 wherein said assembly further comprises means for securing said light source module and said indicator module to a common support.

8. The display assembly of claim 7 wherein said plurality of chambers are formed in a single member that is mounted to the back surface of said front panel.

9. The display assembly of claim 7 wherein said light source module is attached to said common support with the substrate behind an opening in the support and with the light sources facing forwardly toward said support opening and the indicator module is fitted over the light source module with the light sources projecting through the chamber openings.

10. The display assembly of claim 9 wherein the periphery of said indicator module is secured to the common support around the periphery of the support opening.

11. The display assembly of claim 1 wherein said front panel is a polycarbonate sheet with a non-reflective finish on an outer face thereof.

12. The display assembly of claim 1 wherein said front panel includes data indicating areas of a desired color on an inner face thereof and a contrasting color on the inner face in an area not covered by said desired color.

13. The display assembly of claim 1 wherein said data indicating areas are arranged to form segments of a seven segment display capable of displaying any number between 0 and 9 by appropriate selective energization of the light sources.

14. The display assembly of claim 1 wherein said front panel is of a transparent material having coating means to form said data indicating areas by defusing light through said front panel whereby the plurality of discrete light sources appear as a single light source.

* * * * *